US007936231B2

(12) United States Patent
Paquette et al.

(10) Patent No.: US 7,936,231 B2
(45) Date of Patent: May 3, 2011

(54) CIRCULATOR/ISOLATOR HOUSING WITH INSERTS

(75) Inventors: Stanley Vincent Paquette, Dracut, MA (US); William Callanan, Bandon (IE); Rjckard O'Donovan, Dunmanway (IE); Brian Murray, Belgooly (IE)

(73) Assignee: M/A-COM Technology Solutions Holdings, Inc., Lowell, MA (US)

( * ) Notice: Subject to any disclaimer, the term of this patent is extended or adjusted under 35 U.S.C. 154(b) by 0 days.

(21) Appl. No.: 12/849,234

(22) Filed: Aug. 3, 2010

(65) Prior Publication Data

US 2010/0315174 A1 Dec. 16, 2010

Related U.S. Application Data

(63) Continuation of application No. 11/903,730, filed on Sep. 21, 2007, now Pat. No. 7,772,937.

(60) Provisional application No. 60/966,030, filed on Aug. 24, 2007.

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 4,276,522 | A | 6/1981 | Coerver | 333/1.1 |
| 6,337,607 | B1 * | 1/2002 | Genfan | 333/1.1 |
| 6,914,495 | B2 | 7/2005 | Kocharyan | 333/1.1 |
| 7,106,163 | B2 | 9/2006 | Jin et al. | 336/233 |
| 2001/0040484 | A1 | 11/2001 | Kim | 333/24.2 |

* cited by examiner

*Primary Examiner* — Stephen E Jones
(74) *Attorney, Agent, or Firm* — Christopher P. Maiorana, PC

(57) ABSTRACT

A circulator/isolator housing is provided that includes body and a plurality of slots within the body configured to receive therethrough inserts having magnetic permeability. The housing further includes a plurality of receiving portions within the body corresponding to the plurality of slots and configured to maintain a position of the inserts.

17 Claims, 6 Drawing Sheets

CIRCULATOR/ISOLATOR HOUSING WITH INSERTS

This is a continuation of U.S. Ser. No. 11/903,730, filed Sep. 21, 2007 now U.S. Pat. No. 7,772,937, which is incorporated by reference.

CROSS REFERENCE TO RELATED APPLICATIONS

This application claims priority to and the benefit of the filing date of U.S. Provisional Application No. 60/966,030, filed on Aug. 24, 2007 and which is hereby incorporated by reference in its entirety.

BACKGROUND OF THE INVENTION

This invention relates generally to ferrite devices, and more particularly, to a ferrite housing with inserts.

Ferrite devices, and in particular, ferrite circulators are typically configured as multi-port (e.g., three-port) passive RF or microwave devices having within a housing magnets and ferrite material that may be used to control the direction of signal flow in, for example, an RF circuit or a microwave circuit. For example, ferrite circulators may be used to control signal flow in wireless base station or power amplifier applications. Ferrite isolators also may be constructed by terminating one port of a ferrite circulator. Terminating one port results in signal or energy flow in only one direction, which may be used, for example, for isolating components in a chain of interconnected components.

The ferrite device (e.g., ferrite circulator or isolator) typically includes a magnetically biased ferrite disk or slab within a housing that is formed from a ferrous material. The housing for these ferrite devices is typically limited to ferrous materials because of the magnetic permeability requirement of the ferrite device. The housing for these ferrite devices can be metal injection molded, progressive die stamped or machined. The metal injection molded housing requires secondary machining and due to the thermal properties of the ferrous material (e.g., steel) used to form the housing, also requires adding or attaching a more thermally conductive material. These secondary operations add complexity, time and cost to the manufacturing process. The progressive die stamped housing has the same thermal issues as the metal injection molded housing and also requires a secondary machining process to finalize the shape of the housing as formed by the mold. Machining the housing from steel is costly and still requires a separate component or secondary process to address the thermal issues.

At least one known housing addresses these issues by manufacturing the housing from aluminum using a metal injection molded (MIM) process and then adds separate magnetic sections that surround the ferrite element within the housing. This process requires careful alignment of the magnetic sections in secondary operations, as well as finalizing the shape of the housing is secondary operations, which adds time and cost to the overall manufacturing process.

Moreover, the covers for these housings are also typically manufactured from a ferrous material. The covers often include a helical threaded portion that engages a mating portion on the housing. It is often difficult and costly to produce precise threading, particularly when a post plating process is required. Further, an additional steel disc is typically needed within the housing to enhance the magnetic return path in the ferrite assembly. This adds cost and complexity to the overall device.

Thus, known housings for ferrite devices require secondary operations that add complexity and cost to the overall device. The covers for these housings are also often difficult or costly to manufacture.

BRIEF DESCRIPTION OF THE INVENTION

In accordance with an exemplary embodiment, a ferrite housing is provided that includes a body and plurality of slots within the body configured to receive therethrough inserts having magnetic permeability. The ferrite housing further includes a plurality of receiving portions within the body corresponding to the plurality of slots and configured to maintain a position of the inserts.

In accordance with another exemplary embodiment, a cover for a ferrite housing is provided. The cover includes a body formed from steel and a plurality of inclined planes on a top surface of the body.

In accordance with yet another exemplary embodiment, a method of providing a ferrite housing includes configuring a die-castable metal body to receive through slots in the body a plurality of metal inserts. The method further includes configuring a cover to provide a compression fit with the metal body.

DETAILED DESCRIPTION OF THE INVENTION

For simplicity and ease of explanation, the invention will be described herein in connection with various embodiments thereof. Those skilled in the art will recognize, however, that the features and advantages of the various embodiments may be implemented in a variety of configurations. It is to be understood, therefore, that the embodiments described herein are presented by way of illustration, not of limitation.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property. Additionally, the arrangement and configuration of the various components described herein may be modified or change, for example, replacing certain components with other components or changing the order or relative positions of the components.

Various embodiments of the invention provide a housing and cover for a ferrite device. The housing allows for insertion of metal pieces to complete the magnetic path and to provide desired or required magnetic permeability characteristics. The cover for the housing also provides improved engagement and elimination of the need for a steel disc within the ferrite device assembly.

Figure 1:
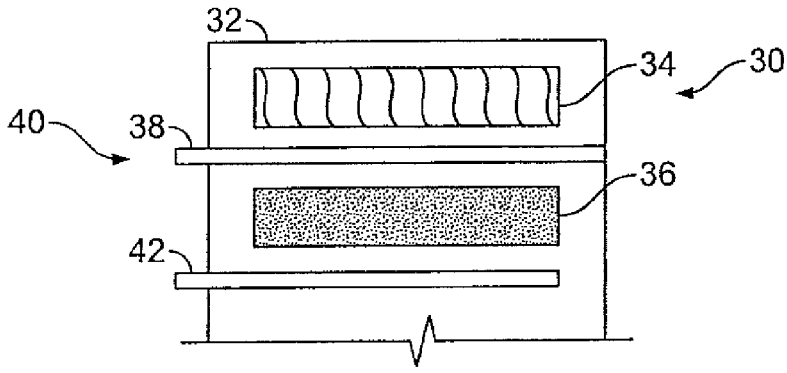
FIG. 1 is a simplified diagram of an exemplary embodiment of a ferrite device.

FIG. 1 is a simplified illustration of an exemplary embodiment of a ferrite device 30, for example, a ferrite circulator or isolator, showing some, but not necessarily all of the components of the ferrite device 30. The ferrite device 30 generally includes a housing 32 defined by a body having one or more magnets 34 and one or more ferrite elements 36 (e.g., ferrite slab or disk) aligned therein. The housing 32 in various embodiments is constructed of a material that provides desired or required thermal properties and is configured to receive inserts (as described in more detail below) to provide magnetic permeability properties. In general, the housing 32 is formed from any material, metal or non-metal, using, for example, a die-cast process. The housing 32 may define one or more cylindrical cavity resonators as described in more detail below.

The ferrite device 30 also includes one or more stripline circuits 38 (only one of the stripline circuits 38 is shown in FIG. 1) defining ports 40 of the ferrite device 30. For example, a Y junction ferrite circulator may be formed by providing three stripline circuits 38 defining three different ports 40 and a Y junction ferrite isolator may be formed by terminating one of the ports. For example, one of the three ports 40 may be terminated as is known using a 50 ohm terminator, which may be formed, for example, from Beryllium Oxide or aluminum nitride. The ferrite device 30 also may include a ground plane 42 for establishing a ground reference within the ferrite device 30. It should be noted that a dielectric (not shown) between different components, for example, between the ground plane 42 and stripline circuit 38 may be provided within the housing 32 of the ferrite device 30.

Further, although only one magnet 34 and one ferrite element 36 are shown, additional magnets 34 and ferrite elements 36 may be provided in a stacked arrangement within the housing 32. Also, additional stripline circuits 38 defining additional ports 40 may be provided (e.g., four stripline circuits defining a four-port ferrite device 30).

Figure 2:
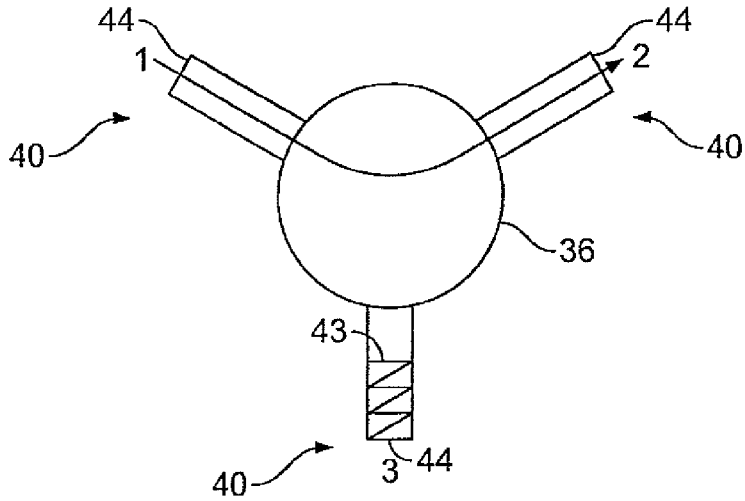
FIG. 2 is a diagram illustrating signal flow through a ferrite device.

In operation, and as shown in FIG. 2, power may be applied to any one of a plurality of transmission lines 44 defined by ports 40 that are formed by stripline circuits 38 extending outside the housing 32. When power is applied to one of the plurality of transmission lines 44, a standing wave pattern (not shown) is established. This electromagnetic field pattern is caused by counter-rotating waves created within the housing 32. It should be noted that coupling and isolation within the ferrite device 30 are determined by the relative position of a port 40 and the standing wave pattern.

The presence of an induced axial magnetic field across the ferrite element 36 changes the effective permeability experienced by the rotating waves based upon the sense of rotation. This causes rotation of the standing wave patterns. For example, the ferrite device 30 may be configured such that the power transfer and isolation properties are provided such that the standing wave pattern is rotated thirty degrees.

Figure 3:
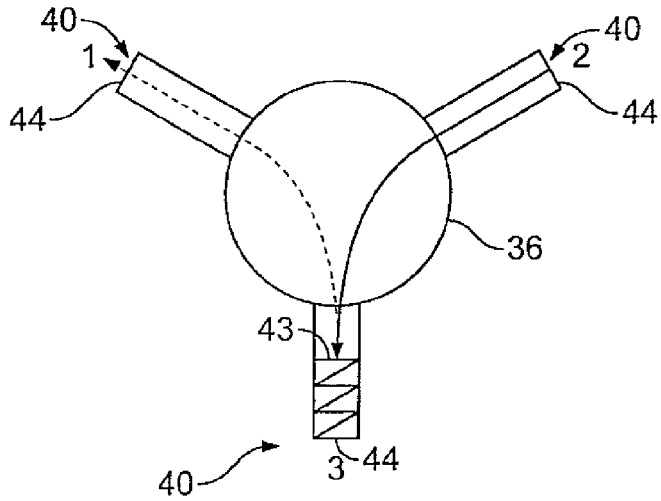
FIG. 3 is a diagram illustrating signal flow isolation in a ferrite isolator.

For a ferrite isolator, and as shown in FIGS. 2 and 3, one of the ports 40 (e.g., port 3) is terminated using a terminator 43 (e.g., 50 ohm termination) to provide a two-port isolator. In this embodiment, with a clockwise direction of circulation, forward power flow is provided from port 1 to port 2 when an input signal is applied to port 1. Reverse power flow is provided from port 2 to port 3 when an input signal is applied to port 2. However, because port 3 is terminated, most of the signal that flows from port 2 to port 3 is absorbed by the terminator 43 as is known. It should be noted that the isolation of flow from port 2 to port 1 is determined by the terminator 43 and the Voltage Standing Wave Ratio (VSWR) of port 3. It also should be noted that some signal flow may be reflected from port 3 and circulated back to port 1. It further should be noted that for a ferrite circulator, the termination is provided externally.

Figure 4:
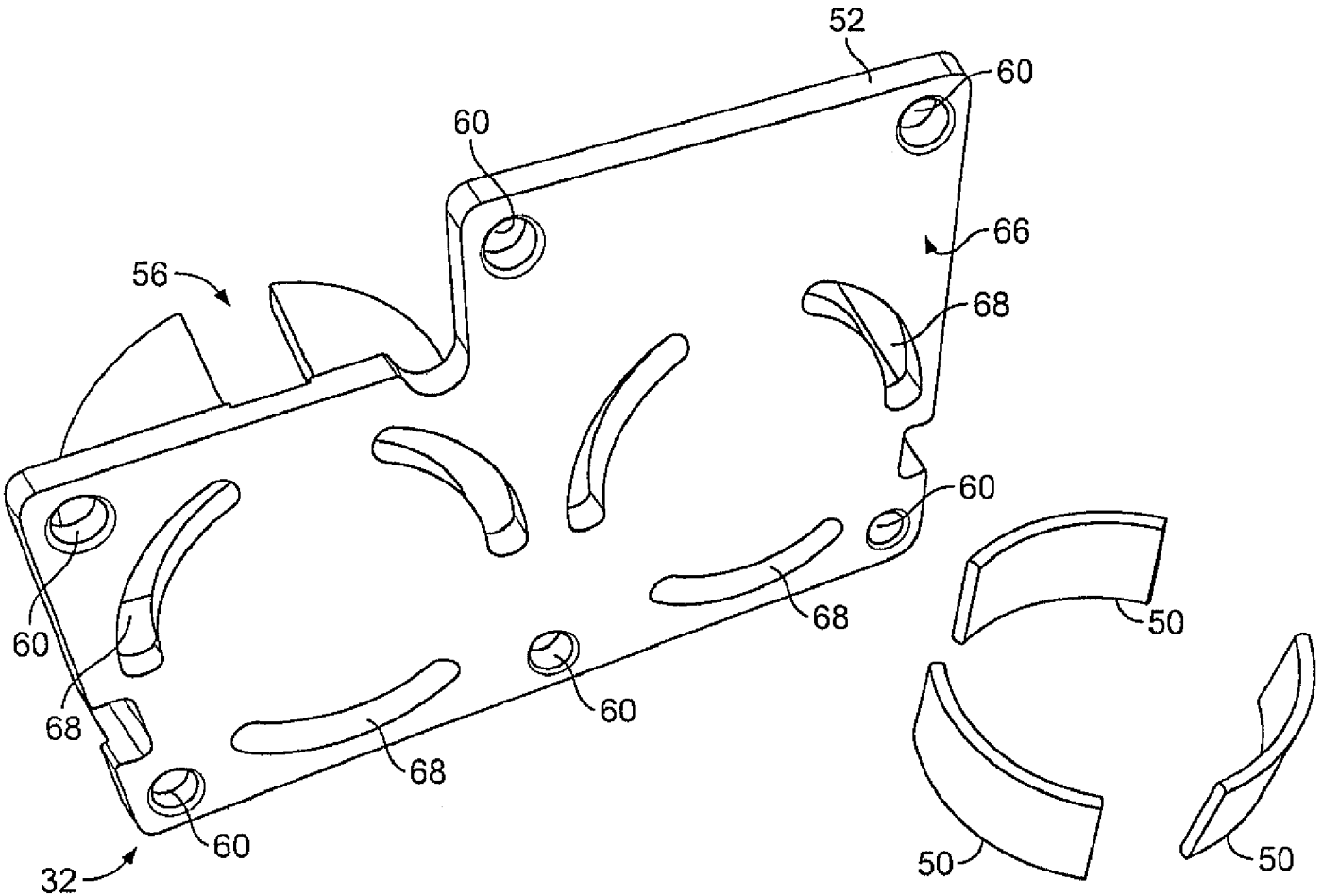
FIG. 4 is a bottom perspective view of a ferrite device housing constructed in accordance with an embodiment of the invention.
Figure 5:
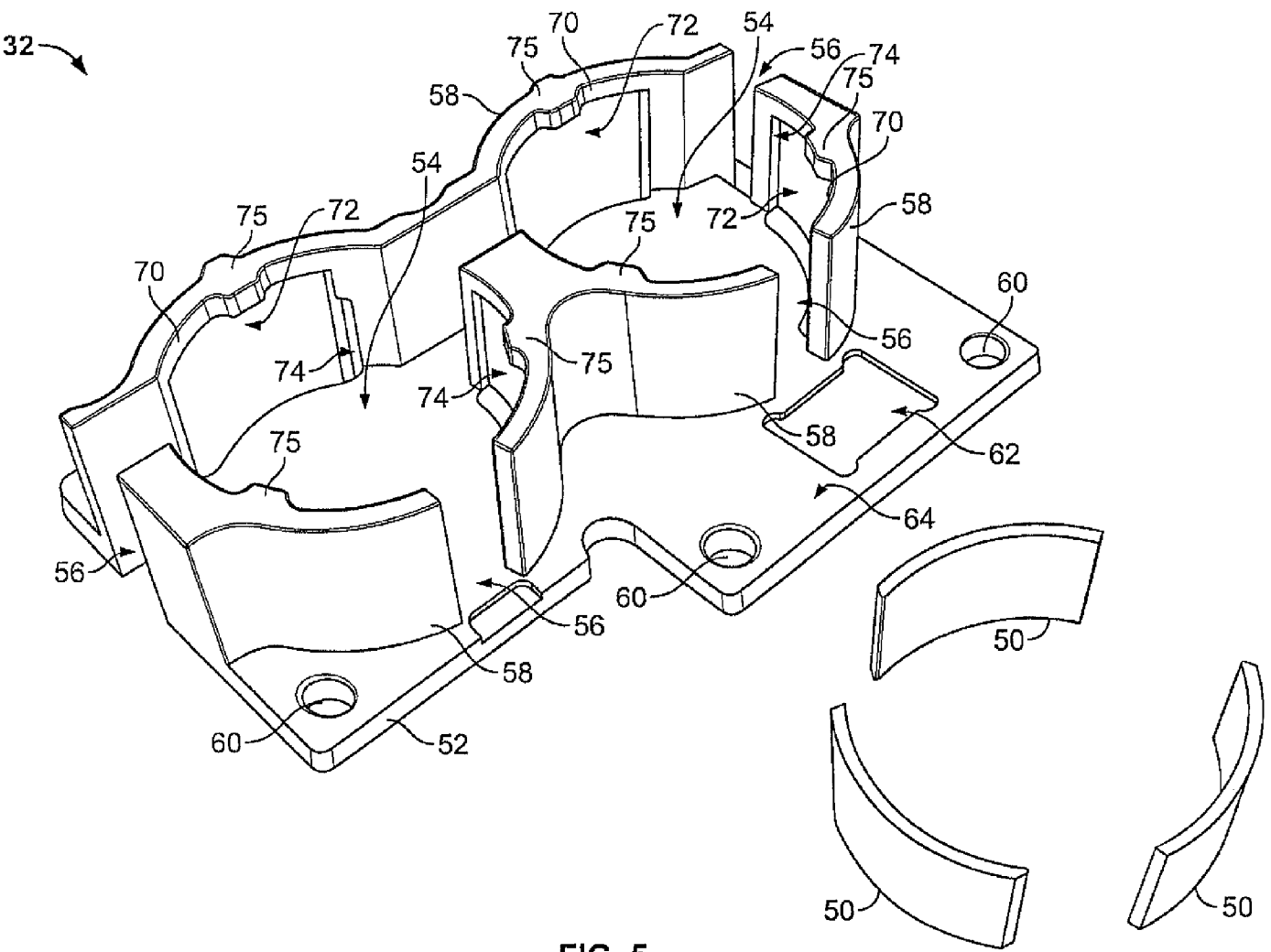
FIG. 5 is a top perspective view of a ferrite device housing constructed in accordance with an embodiment of the invention.

Various embodiments of the invention provide the housing 32 configured to allow the insertion of inserts, such as metal pieces 50 (e.g., ferrous slugs) as shown in FIGS. 4 and 5. More particularly, the housing 32 includes a base 52 and a plurality of cavities 54 defining cylindrical cavity resonators. It should be noted that although the illustrated housing 32 includes two cavities 54 that may be used to construct a dual junction ferrite device, for example, a dual junction ferrite circulator, the housing 32 may include more or less cavities 54. Each of the cavities 54 generally form a body (e.g., a drop-in circulator or isolator body) having a plurality of openings 56 formed between sides or side walls 58 of the cavities 54. It should be noted that different cavities 54 may share a common side wall 58. The openings 56 allow extension therefrom of the stripline circuits 38 (shown in FIG. 1) to define ports 40 (shown in FIGS. 1-3) of the ferrite device. The base 52 also includes a plurality of mounting openings 60 for use in mounting the housing 32, for example, within a microwave device. The mounting openings 60 may be smooth or threaded and used to mount the housing 32 using, for example, screws or bolts. The base 52 may not include any mounting openings 60, for example, when the housing 32 is to be mounted directly to a printed circuit board and fastened with solder. The base 52 also may include at least one terminator mounting portion 62 on a top surface 64 of the base 52 and configured to mount a termination device (as described herein) thereto.

A bottom surface 66 of the base 52 includes a plurality of slots 68 formed therein and that each extends along a portion of the perimeter of the cavities 54. The slots 68 may be evenly or unevenly spaced and although illustrated with three slots 68, additional or fewer slots may be provided. The slots 68 generally extend from the bottom surface 66 of the base to a rim 70 of the side walls 58 and define receiving portions 72 configured to receive therein the metal pieces 50. The receiving portions 72 may each include side channels 74 for receiving sides or edges of the metal pieces 50 to maintain the position of the metal pieces 50 in the receiving portions 72. Additionally, the rim 70 of the side walls 58 (e.g., the reliefs in the side walls 58) prevent the metal pieces 50 inserted within the receiving portions 72 from extending beyond the rim 70 (e.g., extending beyond the top of the housing 32). A tab 75 or other extension is provided at the rim 70 for retention of a cover 80 (shown in FIGS. 6 through 8) to the housing 32 as described in more detail below.

The slots 68 and receiving portions 72 are sized and shaped complementary to the metal pieces 50 such that in one embodiment, the receiving portion is slightly larger dimensionally than the metal pieces 50. In this embodiment, once the metal pieces 50 are inserted within the slots 68, the bottom surface 66 of the base 52 that surrounds the slots 68 is dimpled (e.g., the bottom surface 66 is hit with a center punch to force a portion of the bottom surface 66 over the slot 68) to retain the metal pieces 50 within the receiving portions 72 and to prevent the metal pieces 50 from passing back through the slots 68 (e.g., falling downward out of the slots 68). Alternatively, a resistance element (not shown) may be provided to the slot 68 to prevent the metal pieces 50 from passing back through the slots 68. For example, solder may be applied to a portion of the slot 68 to lock or secure the metal pieces 50 in the receiving portions 72. In another embodiment, the receiving portion 72 is formed to provide a slight interference fit with a metal piece 50 inserted therein such that the metal piece 50 is held in place by this interference fit. In this embodiment, the dimpling or soldering also may be provided to further secure the metal pieces 50 within the receiving portions 72. Any suitable securing arrangement may be used including, but not limited to swaging or glue.

It should be noted that although the slots 68, receiving portions 72 and metal pieces 50 are shown having a semi-cylindrical shape or cross-section, the various embodiments are not limited to a particular shape or size. Accordingly, the slots 68, receiving portions 72 and metal pieces 50 may be shaped and sized differently, for example, based on the size and shape of the cavities 54 or ferrite elements to be inserted therein (e.g., angular to accommodate triangular ferrite elements).

In various embodiments, the housing 32 is formed using a die-cast process as is known. The housing 32 may be formed from, for example, any die castable metal (e.g., aluminum, zinc, magnesium, etc.). For example, magnesium thixomolding may be used to form the housing 32. In general, the housing 32 may be formed from a metal that provides good thermal properties (e.g., thermally conductive), but not necessarily magnetic permeability (e.g., a non-ferrous material). Thus, the housing 32 may be formed, for example, from a zinc casting. Alternatively, the housing 32 may be formed from a composite metal material or alternatively from a non-metal material, for example, plastic. It should be noted that the housing 32 may be plated or coated, for example, with tin, nickel, silver, gold, white bronze, etc.

The metal pieces 50 are formed from metal, for example, steel, such as cold rolled steel. In general, the metal pieces 50 are formed from a metal material having good magnetic properties (e.g., magnetically conductive).

Thus, in the various embodiments, the housing 32 is formed from a thermally conductive material and the insertable metal pieces 50 are formed from a magnetically permeable material or a material having magnetic permeability characteristics such that the magnetic path within a ferrite device is completed by the metal pieces 50 and the housing 32 is no longer in the magnetic path. Thus, the housing 32 can be formed using a die-cast process with the magnetic path completed by the metal pieces 50 inserted within the housing 32.

Figure 6:
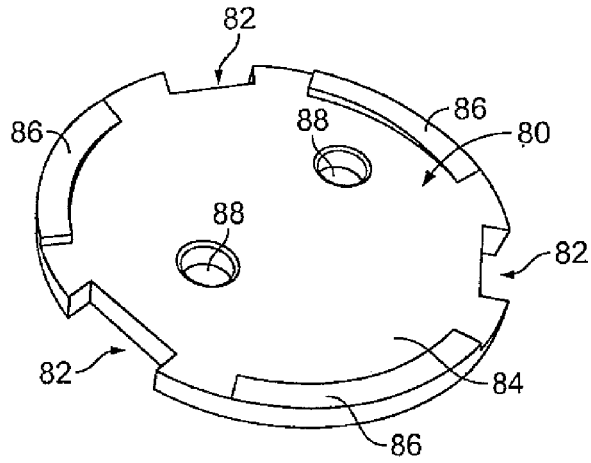
FIG. 6 is a top perspective view of a cover for a ferrite device housing constructed in accordance with an embodiment of the invention.
Figure 7:
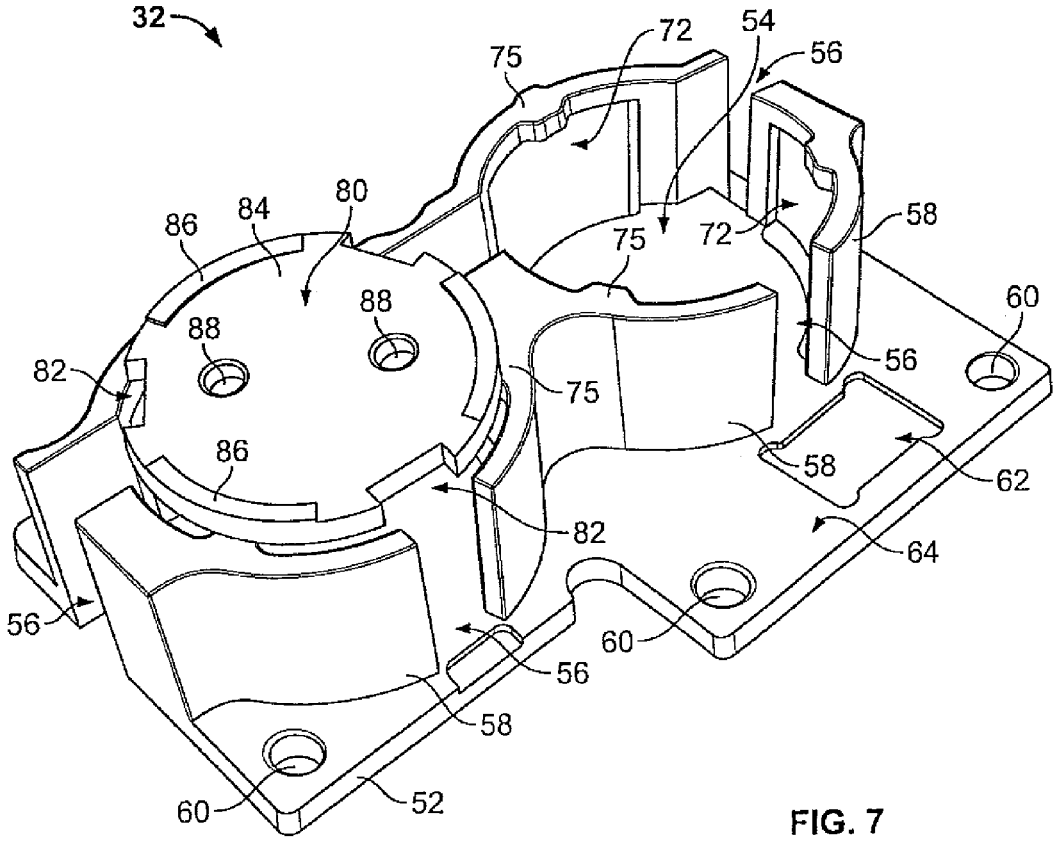
FIG. 7 is a top perspective view of the cover of FIG. 6 with a housing constructed in accordance with an embodiment of the invention.
Figure 8:
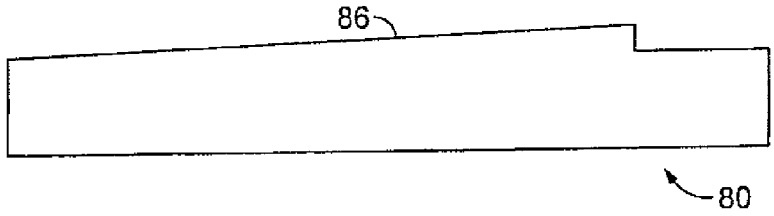
FIG. 8 is a side elevation view of the cover of FIG. 6.

The various embodiments also provide a housing cover 80 as shown in FIGS. 6 and 7 that is configured to engage the housing 32 and maintain the components of the ferrite device therein as described in more detail below. The cover 80 in one embodiment is generally circular in shape to fit within the cylindrical cavities 54 of the housing 32. The cover 80 includes a plurality of notches 82 formed along the edge of the cover 80. The notches 82 are spaced apart at a distance that is the same as the distance that the tabs 75 of the housing 32 are spaced apart. The notches 82 are generally larger than the tabs 75 such that the cover 80 when inserted within the cylindrical cavity 54 slides past the tabs 75. The notches 82 may each be spaced, for example, 120 degrees apart.

A top surface 84 of the cover 80 includes a plurality of engagement members, which in the illustrated embodiment, are a plurality of inclined planes 86 (or ramps). In the various embodiments, an inclined plane 86 is provided between each of the notches 82. The inclined plane 86, as shown more clearly in FIG. 8, extends in a gradual incline along the top edge of the cover 80. For example, each of the inclined planes 86 in one embodiment inclines to a maximum height of about ten thousandths of an inch (254 microns) with the thickness of the cover 80 being between about 40 thousandths of an inch to about 80 thousandths of an inch. It should be noted that additional or fewer inclined planes 86 may be provided and the maximum height changed. Also, the thickness of the cover 80 may be increased or decreased.

The cover 80 also includes a plurality of openings 88, for example, two openings 88 therethrough. The openings 88 are configured, for example, to engage a spanner wrench (not shown) that may be used to tighten the cover 80 on the housing 32 as described in more detail below.

The cover 80 in various embodiments is formed from a metal material, such as steel, for example, cold rolled steel. The cover 80 may be formed using a stamping process as is known. Thus, no machining process is needed, for example, to provide thread cutting. Thus, no additional secondary machining is needed and there is no difficulty with plate build up, which can occur when a threaded cover is provided.

Figure 9:
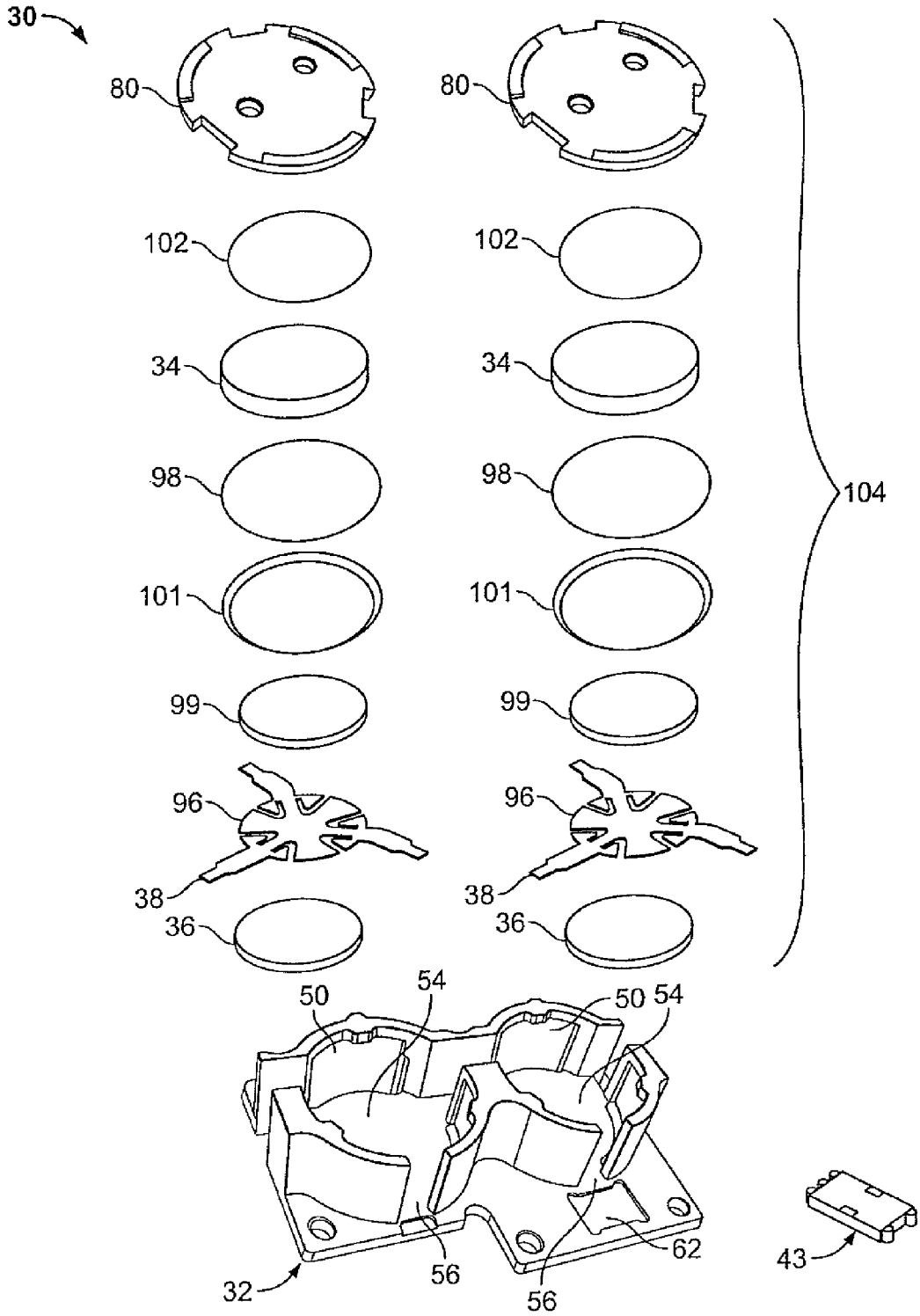
FIG. 9 is an exploded view of a ferrite device constructed using a housing and cover formed in accordance with an embodiment of the invention.

The cover 80 secures numerous ferrite device components within the housing 32 to form a ferrite device 30. For example, as shown in FIG. 9, one or more ferrite elements 36 (e.g., ferrite disks) are inserted within the cavities 54 wherein the metal pieces 50 are also inserted through the slots 68 and secured into the receiving portions 72. A circuit element 96, comprising a plurality of stripline circuits 38 is provided on top of the ferrite element 36. At least one of the stripline circuits 38 extends through an opening 56 and defines a port 40. The stripline circuit 38 may extend from one cavity 54 to another cavity 54 and/or may extend outside the cavity 54. In one embodiment, the stripline circuit 28 extending out of the cavity 54 may be terminated by (e.g., connected to) the terminator 43 mounted within the terminator mounting portion 62. A dielectric 99 is then provided between the circuit element 96 and a ground plane 101. A spacer 98 may be provided between the ground plane 101 and the magnet 34 (when only one ferrite element 36 is included). A pole piece 102 is provided on top of the magnet 34 and the cover 80 is then provided on top of this entire stack 104 and secured to the housing 32 as described below. It should be noted that a cover return or other metal disc is not needed to enhance the magnetic return path.

Figure 10:
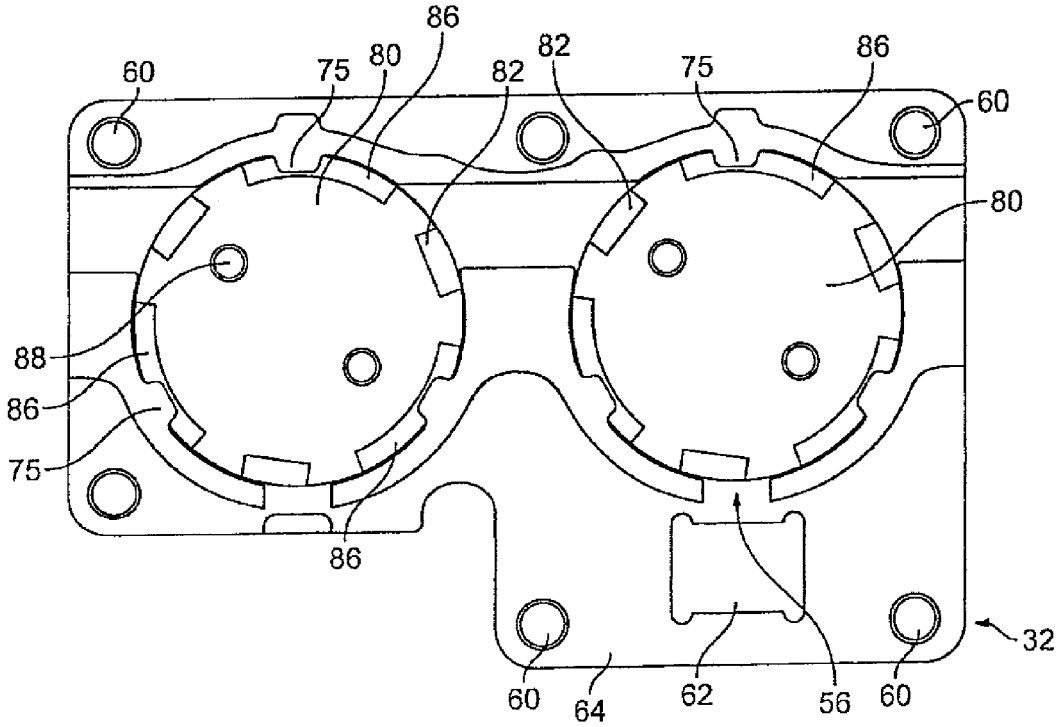
FIG. 10 is a top plan view of ferrite device constructed using a housing and cover formed in accordance with an embodiment of the invention.

Thus, in operation, once all of the elements are stacked within the housing 32 the cover 80 is secured thereto as shown in FIG. 10. More particularly, the cover 80 is placed on top of the stack 104 with the notches 82 allowing the cover 80 to pass by the tabs 75. Thus, the incline planes 86 are underneath the tabs 75. As the cover 80 is rotated (clockwise in the illustrated embodiment), the abutting engagement of the inclined planes 86 under the tabs 75 forces the cover 80 downward onto the stack 104. The cover 80 may be rotated using, for example, a spanner wrench engaged with the openings 88. Thus, the stack 104 is compressed by the cover 80. Once the cover 80 has been rotated a required or desired amount, for example, rotated to sufficiently compress the stack 104 and maintain the engagement of the cover 80 to the housing 32, the cover 80 may be fixedly secured to the housing 32. For example, solder may be used to secure the inclined planes 86 and cover 80 to the tabs 75 and housing 32. In one embodiment, the solder is applied to the inclined planes 86 before rotating the cover 80 such that the solder acts first as a lubricant during rotation and then as a securing substance when dry. It should be noted that the metal pieces 50 may be inserted through the slots 68 and secured within the receiving portions 72 before, during or after the cover 80 is secured to the housing 32.

Accordingly, the various embodiments allow a housing 32 for a ferrite device to be formed from a die-castable metal or non-metal and the cover to be stamped (instead of machined) from a metal. Moreover, the thickness of the cover 80 eliminates the need for an additional disc in the stack 104 and the inclined planes 86 provide compression of the stack 104 within the housing 32 and secure engagement of the cover 80 to the housing 32.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description.

The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

The invention claimed is:

1. An apparatus comprising:

a body comprising a plurality of slots within said body configured to receive therethrough inserts having magnetic permeability, wherein said plurality of slots maintain a position of said inserts; and a cover having a plurality of inclined planes configured to secure said cover to a cavity.

2. The apparatus according to claim 1, wherein said body comprises a base and said plurality of slots are provided on a bottom surface of said base.

3. The apparatus according to claim 1, wherein said body forms a plurality of cavities and said plurality of slots extend along a perimeter of said body.

4. The apparatus according to claim 1, wherein said apparatus further comprises a plurality of tabs configured to maintain said position of said inserts in combination with said plurality of slots.

5. The apparatus according to claim 1, wherein said plurality of slots comprise channels configured to maintain the position of said inserts.

6. The apparatus according to claim 1, wherein said cover comprises cold rolled steel.

7. The apparatus according to claim 1, wherein said plurality of slots is each spaced 120 degrees apart.

8. The apparatus according to claim 1, wherein said cover comprises a plurality of notches.

9. The apparatus according to claim 1, wherein said cover has a thickness of at least 40 thousandths of an inch.

10. The apparatus according to claim 1, wherein said body comprises die-castable metal.

11. The apparatus according to claim 1, wherein said body comprises a non-metal.

12. The apparatus according to claim 1, wherein said body comprises thermally conducting material.

13. The apparatus according to claim 1, wherein a top surface of said cover comprises a plurality of inclined planes.

14. The apparatus according to claim 13, wherein each of said plurality of inclined planes have a maximum height of ten thousandths of an inch.

15. The apparatus according to claim 1, wherein said inserts comprises a metal material.

16. The apparatus according to claim 15, wherein said metal material comprises cold rolled steel.

17. An apparatus comprising:

a body comprising a plurality of slots within said body configured to receive therethrough inserts having magnetic permeability, wherein (a) said plurality of slots maintain a position of said inserts and (b) said body forms a plurality of cavities and said plurality of slots extend along a perimeter of said body; and a plurality of tabs configured to maintain said position of said inserts in combination with said plurality of slots.

* * * * *